United States Patent [19]

Fisher

[11] 4,170,317

[45] Oct. 9, 1979

[54] TOWEL-DISPENSING GOLF BAG INSERT

[76] Inventor: Stanley F. Fisher, 1228-½ W. 29th, Anderson, Ind. 46014

[21] Appl. No.: 776,956

[22] Filed: Mar. 14, 1977

[51] Int. Cl.[2] ..... A63B 57/00; B65D 85/67

[52] U.S. Cl. ..... 221/76; 150/1.5 R; 206/394; 221/199

[58] Field of Search ..... 150/1.5 R, 1.5 C, 52 G; 206/394; 211/16, 495; 221/24, 27-29, 56, 76, 82, 199, 279, 312 A; 224/5 D, 29 B; 242/55.3, 55.42; 248/96; 273/32 R; 280/DIG. 5, DIG. 6; 312/37; D34/5 CB

[56] References Cited

U.S. PATENT DOCUMENTS

| | | | |
|---|---|---|---|
| 637,941 | 11/1899 | Peters | 206/394 |
| 1,414,875 | 5/1922 | Hanaford | 224/5 D |
| 1,625,856 | 4/1927 | Judd | 224/5 D |
| 1,696,184 | 12/1928 | Ashley et al. | 221/29 |
| 2,428,954 | 10/1947 | Apblett et al. | 224/29 B X |
| 3,280,987 | 10/1966 | Steinbock | 206/394 X |
| 3,370,805 | 2/1968 | Barbee | 242/55.42 |
| 3,457,389 | 7/1969 | Knapp | 211/16 X |

*Primary Examiner*—Robert J. Spar
*Assistant Examiner*—Francis J. Bartuska
*Attorney, Agent, or Firm*—Woodard, Weikart, Emhardt & Naughton

[57] ABSTRACT

A towel-dispensing golf bag insert comprising an elongated tubular container having a central axis, a cap removably mounted to one end of the container, a rod of about the same length as the container and located along the container's central axis, and a base mounted to the end of the rod opposite the cap. The rod is reciprocable along the central axis of the container when the cap is removed and several towels are concentrically wrapped around the shaft of the rod being securely held against the rod as it is reciprocated. The rod further includes several vertically-spaced shelves which operate to separate the towels along the rod and a handle mounted to the end of the rod opposite the base for use in reciprocating the rod within the container. An end plug is also fixedly mounted to the end of the container opposite the cap and the completed towel dispenser is insertable into a conventional golf bag.

8 Claims, 2 Drawing Figures

TOWEL-DISPENSING GOLF BAG INSERT

BACKGROUND OF THE INVENTION

1. Field of the Invention

This invention relates to towel dispensers and particularly to the use of such dispensers in a golf bag.

2. Description of the Prior Art

The prior art regarding towel-dispensing inserts for golf bags is apparently very limited. Many golfers choose to carry a towel that is removably fastened to their golf bag or golf cart in order to have a ready means for wiping their ball, clubs, or hands in the event they become muddy or wet. The only alternative to such methods provided by the prior art appears to be the combination of a golf club head cover and a towel as shown in Stewart, U.S. Pat. No. 3,938,570 and Hyden et al., U.S. Pat. No. 3,831,652.

The disadvantages with such prior art towel holders or dispensers are several. First, the towels are often bulky and become easily intangled in the bag strap or the clubs thereby becoming more inconvenient than useful. Second, the average golfer carries only one such towel and after it has become wet or muddy, its usefulness is lost.

The towel-dispensing golf club insert of the present invention avoids the disadvantages common to the art while providing a readily-accessible supply of clean towels for use by the golfer.

SUMMARY OF THE INVENTION

One embodiment of the present invention comprises a towel-dispensing golf club insert including an elongated container having a central axis and adapted for insertion into a golf bag, a cap removably mounted to one end of the container, a rod of about the same length as the container and reciprocable along the container's central axis, and a base mounted to the end of the rod opposite the cap. A plurality of towels are concentrically wrapped around the shaft of the rod and are securely held in place as the rod is reciprocated within the container. Also provided are a number of vertically-spaced shelves connected to the shaft of the rod which operate to separate the towels along the rod. The container is tubular in axial cross section and includes an end plug fixedly mounted to the end of the container opposite the cap. A handle is also mounted to the end of the rod opposite the base for use in reciprocating the rod within the container.

An object of the present invention is to provide an improved towel-dispensing golf bag insert which provides a ready supply of clean, dry towels to the golfer.

Another object of the present invention is to provide an improved towel-dispensing golf bag insert which is not bulky or burdensome to the golfer and which readily fits into the great majority of golf bags.

Further objects and advantages of the present invention will become apparent from the following description and claims, and from the accompanying drawings.

DESCRIPTION OF THE PREFERRED EMBODIMENT

Figure 1:
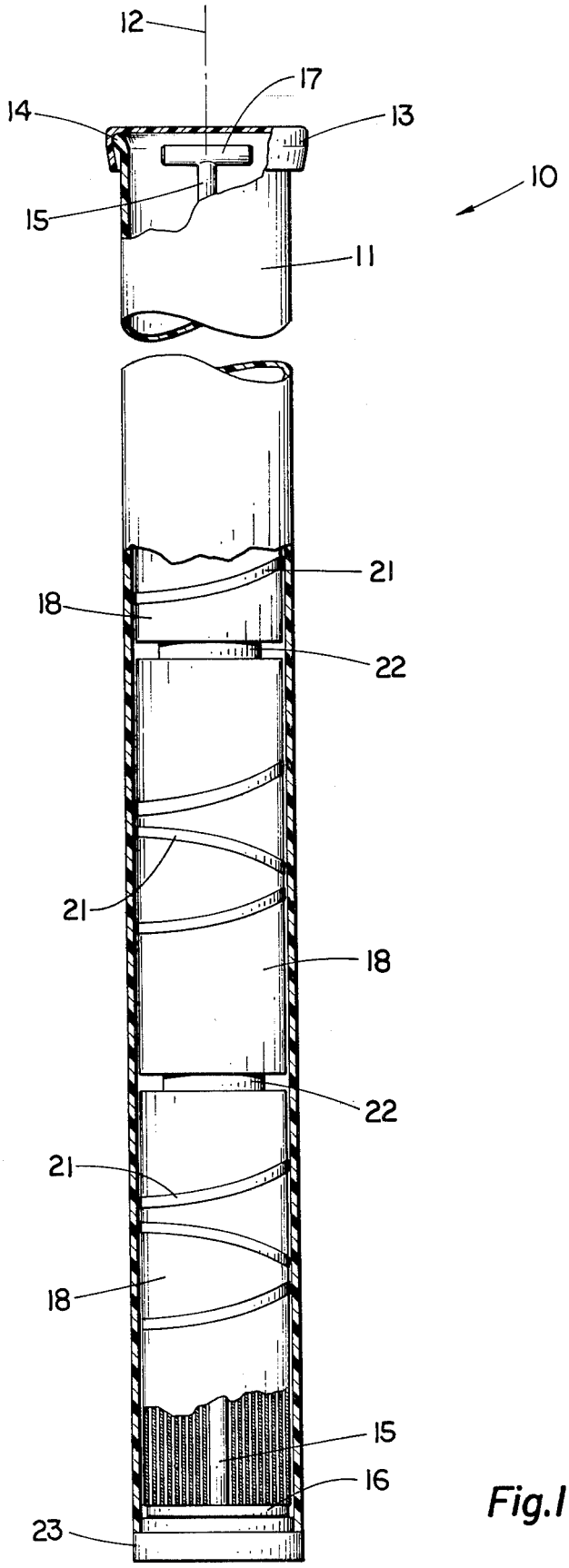
FIG. 1 is a fragmentary sectional view of the towel-dispensing golf bag insert comprising the preferred embodiment of the present invention.

For the purposes of promoting an understanding of the principles of the apparatus of the present invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, the towel-dispensing golf bag insert 10 comprising the preferred embodiment of the present invention is therein depicted. An elongated container 11 is provided having a central axis 12 and a tubular axial cross section. The container is between about 2½ feet and about 3½ feet in length and is between about ¾ of an inch and about 3 inches in diameter. The exact dimensions of a particular towel-dispensing golf bag insert 10 may thus vary greatly depending on the size of the golf bag and the size and quantity of towels sought to be contained therein. The container of the preferred embodiment is made of a flexible opaque plastic material; however, a wide variety of materials may be used to construct the container.

A cap 13 is removably mounted to one end of the container 11. For the purposes of this application, the term "cap" shall be understood to refer to any variety of removable device that may be employed to enclose one end of the container 11. Some examples include a screw-on lid, a disc or plug, and a hinged top. However, in the preferred embodiment, cap 13 is also composed of a flexible plastic material and is adapted to snap on and off of a flared lip 14 on the end of container 11.

A rod 15 of about the same length as the container 11 is located along central axis 12 of the container. A disc or base 16 is mounted to the end of the rod opposite cap 13; and when the cap is removed, the rod and base are reciprocable along central axis 12 of the container. A handle 17 is mounted to the end of rod 15 opposite base 16 and may be gripped to assist in reciprocating the rod within the container.

A plurality of towels 18 are concentrically wrapped around the shaft of rod 15 and are axially reciprocable therewith. Elastic bands 21, or other holding means such as string or tape, are also provided for holding the towels 18 close to the shaft of rod 15 thereby preventing any snagging or binding with the inside wall of container 11. The exact number of towels and elastic bands contained in a particular towel-dispensing golf bag insert is of course, dependent upon the dimensions of the container and the specific towels. Any variety of disposable or nondisposable cloth or paper towels may be used with the present invention, the only criteria being that the towels must be capable of being wrapped tightly enough around the rod to be slidable in the particular container.

A number of vertically-spaced shelves 22 are connected to the shaft of rod 15 and are employed to separate the towels 18 along the rod. Many configurations for such shelves may be employed. In addition, no such shelves may be necessary if the particular towels are such that overwrapping and binding does not occur when the towels are wrapped end-to-end along rod 15.

An end plug 23 is also fixedly mounted to the end of container 11 opposite cap 13 thereby sealing off the end of the container.

Figure 2:
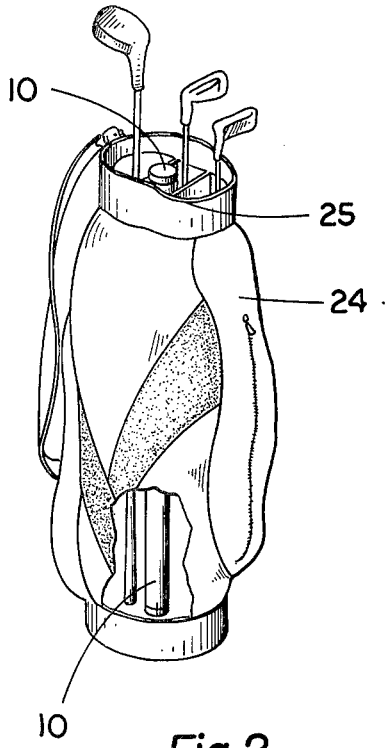
FIG. 2 is a fragmentary view of the towel-dispensing golf bag insert in FIG. 1 positioned in a conventional golf bag.

Referring now to FIG. 2, the towel-dispensing golf bag insert 10 as described above and shown in FIG. 1 is depicted in combination with a conventional golf bag 24. The particular length of insert 10 is chosen such that upon insertion, the insert is about the same length as the inside compartment in the golf bag and thereby extends to about the upper level 25 of the bag.

To withdraw a towel from the towel-dispensing insert, the golfer first removes cap 13 and partially withdraws rod 15 from container 11. He then removes the elastic band 21 from a towel 18 and unwraps the towel from around the shaft of rod 15. He next returns rod 15 to its initial position within container 11 and snaps cap 13 back over flared lip 14.

The operation of the towel-dispensing golf bag insert of the present invention is thus very simple while providing major advantages over the prior art towel holders and dispensers.

The present invention takes up little room in the golf bag and can experience no tangling with the bag strap or the clubs. In addition, the golfer is provided with a ready supply of clean, dry towels for his use.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A towel-dispensing golf bag insert comprising:

(a) an elongated container having a central axis;

(b) a cap removably mounted to one end of said container;

(c) a rod of about the same length as said container and located along the central axis of said container, said rod being reciprocable along the central axis when said cap is removed;

(d) a base mounted to the end of said rod opposite said cap;

(e) a plurality of towels concentrically wrapped around the shaft of said rod and axially reciprocable therewith;

(f) and means for holding said towels around said rod while said rod is reciprocated along the central axis of said container, said means for holding including an elastic band.

2. The insert of claim 1 additionally comprising a plurality of vertically-spaced shelves connected to the shaft of said rod, said shelves being adapted to separate said towels along said rod.

3. The insert of claim 2 in which said container is tubular and between about ¾ inches and about 3 inches in axial cross section, said container further being between about 2½ feet and about 3½ feet in length.

4. A towel-dispensing golf bag insert comprising:

(a) an elongated container having a central axis, said container being tubular and between about ¾ inches and about 3 inches in axial cross section, said container further being between about 2½ feet and about 3½ feet in length;

(b) a cap removably mounted to one end of said container;

(c) a rod of about the same length as said container and located along the central axis of said container, said rod being reciprocable along the central axis when said cap is removed;

(d) a base mounted to the end of said rod opposite said cap;

(e) a plurality of towels concentrically wrapped around the shaft of said rod and axially reciprocable therewith;

(f) means for holding said towels around said rod while said rod is reciprocated along the central axis of said container;

(g) a plurality of vertically-spaced shelves connected to the shaft of said rod, said shelves being adapted to separate said towels along said rod;

(h) an end plug fixedly mounted to the end of said container opposite said cap;

(i) and a handle mounted to the end of said rod opposite said base and adapted to aid in reciprocating said rod along the central axis of said container.

5. The combination, comprising:

(a) a golf bag;

(b) a tubular container inserted in said golf bag, said container being about the same length as the inside compartment in said golf bag;

(c) a cap removably mounted to one end of said container;

(d) a rod of about the same length as said container and located along the central axis of said container, said rod being reciprocable along the central axis when said cap is removed;

(e) a base mounted to the end of said rod opposite said cap;

(f) and a plurality of towels concentrically wrapped around the shaft of said rod and axially reciprocable therewith.

6. The combination of claim 5 additionally comprising:

(a) a plurality of vertically spaced shelves connected to the shaft of said rod, said shelves being adapted to separate said towels along said rod; and (b) means for holding said towels around said rod while said rod is reciprocated along the central axis of said container.

7. The combination of claim 6 in which said container is tubular and between about ¾ inches and about 3 inches in axial cross section, said container being between about 2½ feet and about 3½ feet in length.

8. The combination of claim 7 additionally comprising:

(a) an end plug fixedly mounted to the end of said container opposite said cap; and (b) a handle mounted to the end of said rod opposite said base, and adapted to aid in reciprocating said rod along the central axis of said container.

* * * * *